US005706904A

United States Patent [19]

Turriff et al.

[11] Patent Number: 5,706,904

[45] Date of Patent: Jan. 13, 1998

[54] SOIL SAMPLING TOOL WITH VOLUME-INDICATING FEATURE

[75] Inventors: David E. Turriff; Lloyd E. Jacobs; Nils K. Melberg; Christopher A. Reitmeyer, all of Green Bay, Wis.

[73] Assignee: En Novative Technologies, Inc., Green Bay, Wis.

[21] Appl. No.: 686,147

[22] Filed: Jul. 24, 1996

[51] Int. Cl.[6] ..... E21B 49/02

[52] U.S. Cl. ..... 175/20; 73/864.44; 73/864.62; 172/22

[58] Field of Search ..... 73/864.44, 864.45, 73/864.62; 175/20; 172/22

[56] References Cited

U.S. PATENT DOCUMENTS

| | | | |
|---|---|---|---|
| 1,783,026 | 11/1930 | Ober | 172/22 X |
| 3,273,930 | 9/1966 | Gottfried | 73/864.44 X |
| 3,326,049 | 6/1967 | Eley . | |
| 3,444,938 | 5/1969 | Bellmann | 73/864.44 X |
| 3,497,018 | 2/1970 | Schultz et al. | 175/20 X |
| 3,586,109 | 6/1971 | Eversole et al. | 172/22 |
| 4,116,247 | 9/1978 | Zanasi | 73/864.44 X |
| 4,549,612 | 10/1985 | Cushing | 175/20 |
| 4,729,437 | 3/1988 | Zapico | 175/20 |
| 4,763,735 | 8/1988 | Gay | 172/22 X |
| 4,819,735 | 4/1989 | Puckett | 172/22 |
| 4,884,638 | 12/1989 | Hoffman | 172/22 |
| 4,888,999 | 12/1989 | Kozak | 73/864.44 X |
| 4,989,678 | 2/1991 | Thompson | 175/20 |
| 5,343,771 | 9/1994 | Turriff et al. | 73/864.44 |
| 5,492,021 | 2/1996 | Bourgeois et al. | 73/864.45 |
| 5,505,098 | 4/1996 | Turriff et al. | 73/864.44 |
| 5,517,868 | 5/1996 | Turriff et al. | 73/864.44 |
| 5,522,271 | 6/1996 | Turriff et al. | 73/864.44 |
| 5,587,540 | 12/1996 | Meyer | 73/864.44 |

FOREIGN PATENT DOCUMENTS

| | | | |
|---|---|---|---|
| 387243 | 6/1973 | U.S.S.R. | 73/864.44 |
| 1891324 | 5/1993 | U.S.S.R. | 73/864.44 |
| 522286 | 6/1940 | United Kingdom | 172/22 |
| 2234493 | 2/1991 | United Kingdom | 73/864.62 |

*Primary Examiner*—Thomas P. Noland
*Attorney, Agent, or Firm*—Jansson, Shupe, Bridge & Munger, Ltd.

[57] ABSTRACT

The disclosure involves a soil-sampling tool having a barrel with a distal end for insertion into soil, and a plunger mounted for movement in the barrel. The plunger includes a soil-contact surface spaced from the distal end by a dimension when the barrel is filled with a soil sample having a volume. The improved tool includes a locking mechanism setting the dimension equal to a reference dimension, thereby establishing the volume of the soil sample to be equal to a predetermined or reference volume. In a more specific embodiment, there is an annular space between the barrel wall and the plunger head. Such head includes plural resilient sealing rings for sealing against the wall and closing the space. The tool also includes a feature for venting air otherwise trapped between the barrel/soil sample and the cap being mounted to the barrel.

18 Claims, 6 Drawing Sheets

VA15

SOIL SAMPLING TOOL WITH VOLUME-INDICATING FEATURE

FIELD OF THE INVENTION

The invention relates generally to measuring and testing and, more particularly, to devices used for soil testing.

BACKGROUND OF THE INVENTION

Soil sampling tools and devices are used for a variety of purposes, e.g., to obtain samples for soil moisture content or to learn whether and to what extent a volatile organic compound (VOC) may have permeated the soil. And soil cores are removed for other reasons unrelated to VOC analysis. Examples of soil coring and sampling tools are shown in U.S. Pat. Nos. 3,326,049 (Eley); 3,444,938 (Ballman); 3,497,018 (Schultz et al.); 4,729,437 (Zapico); 4,819,735 (Puckett); 4,888,999 (Kozak); 4,989,678 (Thompson); 5,505,098 (Turriff et al.); 5,522,271 (Turriff et al.) and 5,517,868 (Turriff et al.).

The invention relates particularly to soil sampling for assaying a VOC which may be present in a sample. It is common knowledge that tanks for storing liquid may, over time, develop a leak. If the tank is above ground, the leak is usually observed rather soon after its onset and not much damage results. On the other hand, there is an already-substantial and growing awareness that certain types of liquid storage tanks placed underground have a greater-than-normal propensity to deteriorate and leak. Such types include tanks made of steel from which protective coatings have either been eaten away or were non-existent.

And a substantial factor contributing to the risk of tank leakage is that with an underground tank, leakage is not visible. Usually, such leakage, its seriousness and appropriate remediation steps can only be determined after excavation and testing.

Undetected leaks of underground storage tanks can and do contaminate soil and potable water supplies. Because of the number of gasoline service stations and private fuel and solvent storage tanks, leakage of volatile organic compounds (VOCs) such as petroleum distillates and hydrocarbons is a problem of particular concern.

Good remediation requires that personnel be able to accurately determine the nature and extent of the leak. This involves ascertaining the degree to which soil may be contaminated by a VOC.

Analysis of VOC contamination of a soil sample is by placing the sample into a laboratory vial with chemicals used for such analysis. There are at least two ways to conduct such an analysis.

One way involves weighing the sample and then placing into the vial a quantity of analytical chemical consistent with such weight. This procedure takes time and, of course, lapsed time is the enemy of high-integrity samples. Lapse of time between taking the sample and analyzing it can (unless careful precautions are taken) result in significant evaporation of VOC from the sample and consequent "false readings." (For example, the open-mouthed samplers disclosed in the Eley, Schultz, Zapico, Puckett and Thompson patents would permit significant evaporation of VOC.)

Another way to analyze a soil sample is to assume that the sample expelled from a sampling tool into a lab vial will have a weight that is within a relatively-narrow range of weights. A sample having such a weight can, upon arrival at a laboratory, be immediately expelled into a vial already containing an analytical chemical (a solvent or preservative) or water. The quantity of such chemical or water in the vial pre-supposes that the incoming sample will have a specified weight. Or, more typically, the soil sample is first placed into the vial and the chemical or water added thereafter. But for either procedure, it is advantageous to be dealing with a soil sample of approximate known volume.

But unless the sampling tool is somehow marked with indicia of sample weight and unless the tool plunger is retained in a position during tool/sample transport (thereby helping avoid soil falling out of the tool), the sample may not, in fact, be of the assumed weight. A flawed analysis of a VOC can very well follow.

A sampling tool having indicia thereon that correlates with sample weight is shown in the Eley patent noted above. After a sample is taken with the threaded, marked shaft fully retracted and the piston up inside the barrel-like body, such shaft is rotated to push the soil sample outwardly. As the sample extrudes, soil "discs" (or increments as the patent calls them) are cut from the sample and the aggregate weight of such discs is measured.

When the weight of the cut discs becomes equal to some given weight, the marked shaft may be viewed to learn the volume of soil having such weight. The user can thereupon ascertain soil moisture content.

While this undoubtedly works acceptably well for measuring soil moisture content, it is unacceptable for sampling soil suspected of containing VOC—clearly it would permit VOC vapor to escape. Soil samplers used for moisture content measurement have their pistons positioned at the mouth of the sample-receiving body just prior to inserting such body into the soil being tested. The force of the soil filling the body urges the piston up the body.

But unless the piston shaft has marker indicia thereon which is visible upon withdrawal of the tool from the soil, it is not easy to be sure that the soil sample is of the proper volume. (It should be noted that in a tool of the type Shown in the Turriff '868 patent, the piston shaft may be obscured by a handle.)

Another difficulty with known soil sampling tools (not necessarily useful for VOC analysis) is that they have built-in opportunities for creating a degree of friction between the piston and body that may prevent smooth movement of such piston along the body. If a piston cannot move smoothly, there is a greater likelihood that the volume of soil in the body may not have the desired volume.

For example, the lawn aerator shown in the Puckett patent has a sample-expelling piston with a supple, expandable washer sandwiched between two rigid washers and held there by lock nuts.

The Puckett patent explains that the lock nuts can be tightened to expand the supple washer and make a tighter fit between piston and body. An arrangement described in the Zapico patent apparently works in much the same way. One concerned with accuracy of soil sample volume, e.g., a person analyzing soil for VOC, does not want the vagaries of variable piston travel that can result from changes in fit between piston and body.

Yet another disadvantage of known sampling tools arises from the fact that they do not provide a good seal for retaining VOC vapor in a soil sample. For example, the closure plate shown in the Schultz et al. patent does not seal against the tube. There is slight clearance between such plate and tube. And the aerator disclosed in the Puckett patent is vented.

Still another disadvantage of known sampling tools relates to the fact that the soil being sampled can migrate to the seal being relied upon to trap VOC vapors. Soil between such seal and the tube wall can cause tiny gaps between the seal and the wall and impair the integrity with which the tool preserves the VOC vapors in a soil sample contaminated with VOC.

A recently-identified difficulty relating to sampling tools of the type disclosed in the Turriff et al. patents (i.e., tools having caps for VOC entrapment) is that air can become trapped between the cap and the barrel. Such trapped air may prevent a good seal and has the potential to permit VOC to evaporate to some degree before the soil sample can be analyzed.

An improved sampling tool which addresses disadvantages inherent in prior art sampling tools would be a significant advance in this technical field.

OBJECTS OF THE INVENTION

It is an object of the invention to provide an improved soil sampling tool overcoming some of the problems and shortcomings of the prior art.

Another object of the invention is to provide an improved soil sampling tool which is particularly well adapted for taking samples of soil contaminated with VOC.

Yet another object of the invention is to provide an improved soil sampling tool which has a feature indicating whether or not the volume of soil in the tool is equal to a reference volume.

Another object of the invention is to provide an improved soil sampling tool which preserves the integrity of the sample (and, particularly, of the VOC vapor in the sample) being collected.

Still another object of the invention is to provide an improved soil sampling tool which has a plunger moving smoothly under the urging of the soil entering the tool barrel.

Another object of the invention is to provide an improved soil sampling tool having provisions for venting air otherwise entrapped between the tool barrel and cap while yet providing a good cap-to-barrel seal. How these and other objects are accomplished will become apparent from the following descriptions and from the drawings.

SUMMARY OF THE INVENTION

Before summarizing the invention, it will be helpful to have an understanding of some of the rationale underlying such invention. As noted above, a way to analyze a soil sample is to assume that the sample expelled from a sampling tool into a lab vial will have a weight that is within a relatively-narrow range of weights. Preferably, the weight of the sample is between about 3.5 grams and about 6.5 grams. Most preferably, the soil sample will weigh about 5 grams.

A sample having such a weight can, upon arrival at a laboratory, be immediately expelled into a vial already containing an analytical chemical (a solvent or preservative) or water. The quantity of such chemical or water in the vial pre-supposes that the incoming sample will have a specified weight. Or, more typically, the soil sample is first placed into the vial and the chemical or water added thereafter. But for either procedure, it is advantageous to be dealing with a soil sample of approximate known weight.

It is noted that desired sample "size" is defined above in terms of weight, not volume. It has been found that if a soil sample has a particular volume, e.g., about 0.2 cubic inches in a highly preferred embodiment, the sample will have a weight within the above-stated range, irrespective of whether such sample is taken from clay, sandy or loam soil. Aspects of the invention will now be summarized.

The invention involves a soil-sampling tool of the type including a barrel having (a) a distal end for insertion into soil, and (b) a plunger mounted for movement in the barrel. The plunger includes a soil-contact surface spaced from the distal end by a dimension when the barrel is filled with a soil sample having a volume.

In the improvement, the tool includes a locking mechanism setting the dimension equal to a reference dimension, thereby establishing the volume of the soil sample to be equal to some predetermined reference volume. In one specific testing "protocol," the volume is that which yields a sample weight of 5 grams within some tolerance range.

In another aspect of the invention, the barrel includes a proximal end spaced from the distal end and the plunger includes a stem extending through and movable in the proximal end. The locking mechanism coacts between the proximal end and the stem and prevents movement of the stem toward the distal end.

In a highly preferred embodiment, the locking mechanism includes first and second locking members and when the dimension is equal to a reference dimension, the locking members may be engaged. When the sample-filled barrel is "set up" for carrying to a test laboratory, such locking members are engaged.

In a more specific aspect of the invention, the first locking member includes a ramp-like or cam-like locking ledge. The second locking member includes an arm projecting away from the stem and engaging the ledge.

It is preferred that the new tool have provisions making the locking mechanism quick and easy to use by "prepositioning" the locking members with respect to one another as the soil sample is received in the barrel and the plunger moves along such barrel. To that end, the barrel proximal end has a first deformation and the plunger includes a stem movable in the proximal end and having a second deformation. The deformations are conformably-shaped to guide movement of the stem in the proximal end.

In a specific embodiment, the first deformation includes a groove and the second deformation includes the above-noted arm extending from the stem and into the groove. In a more symmetrical embodiment which helps prevent "cocking" of the plunger and the stem during locking (with possible partial loss of integrity of the plunger head seal described below), there are two diametrically-opposed grooves and two diametrically-opposed arms extending respectively into such grooves.

In another aspect of the invention, the barrel includes a sampling cavity defined by a barrel distal end for receiving a soil sample through such end and into the cavity. The cavity is bounded by an annular, "face-like" surface or terminus away from the distal end. The barrel interior wall extends between the distal end and the terminus.

The plunger is mounted for movement in the cavity and includes an enlarged head from which the stem protrudes. The head has a somewhat smaller cross-sectional area than the cavity so that the head and the wall define a space between them. The head includes a resilient sealing ring thereon, e.g., a circular ring, for sealing against the wall adjacent to the terminus and closing the space. The head is free of any mechanism for adjusting the compression of such sealing ring. (When the head and wall are cylindrical as in the preferred embodiment, the diameter of the head is somewhat less than the diameter of the cavity defined by the wall and define an annular space between them.)

In yet another aspect of the invention, the barrel distal end defines a first area. The cavity terminus defines a second area smaller than the first area and the cavity is slightly tapered from the distal end to the terminus. While the head may have but a single sealing ring thereon, a highly preferred embodiment includes plural resilient sealing rings (preferably two rings) for sealing against the wall and closing the space. As with an embodiment having but a single sealing ring, the head is free of any mechanism for adjusting the compression of the plural sealing rings.

In the highly preferred embodiment having two sealing rings, one of the rings is redundant for containing vapor of a VOC in the barrel. And that ring closest to the barrel distal end acts as a secondary seal which helps prevent dirt from working its way under the other ring and impairing the integrity of VOC vapor retention. And in a more-specific embodiment, the barrel distal end has a first diameter and the cavity terminus has a second diameter less than the first diameter. That is, the cavity is slightly tapered from the distal end to the terminus.

The disclosed sampling tool is of the type configured for hand insertion into soil which may be contaminated with VOC. To that end, the barrel has a short hand-grip handle, preferably T-shaped, coupled to it. A preferred way of handle-barrel coupling is by forming a pair of opposed channels in the barrel proximal end, forming the handle connection member to have a pair of opposed ears extendingly radially inwardly and slipping the ears into respective channels.

Most preferably, each channel has an axial component and another component angular to such component. In that way, the ears can be urged along the axial component and then twisted into the other component to provide something of a "twist-lock" connection between handle and barrel.

And that is not all. The new tool has yet other features contributing to its fine performance as a sampling tool for analyzing the presence of VOC in soil. For example, the handle of the tool optionally includes a sighting aperture and the plunger stem optionally includes a volume marker thereon. The aperture and the marker are aligned with one another when the barrel is filled with a soil sample having a volume substantially equal to a reference volume, e.g., a volume characteristic of a soil sample weighing about 5 grams.

Another desirable feature of the tool helps assure that when capping the tool barrel, no air will be trapped between the barrel distal end (and the soil sample in the barrel) and the cap fitted on such distal end. Air entrapment is possible since such cap has a sealing ring lodged in an interior, circumferential cap groove and bearing against the barrel outer surface when the cap is fully seated.

To help prevent air entrapment, the barrel outer surface has at least one rib thereon. As the cap is mounted on the barrel distal end, the rib compresses the sealing ring and forms a small opening between such ring and such surface. Air between the cap and the soil sample is vented through such opening as the cap is being mounted.

Other features of the invention are set forth in the following detailed description and in the drawings.

DETAILED DESCRIPTIONS OF PREFERRED EMBODIMENTS

Figure 1:
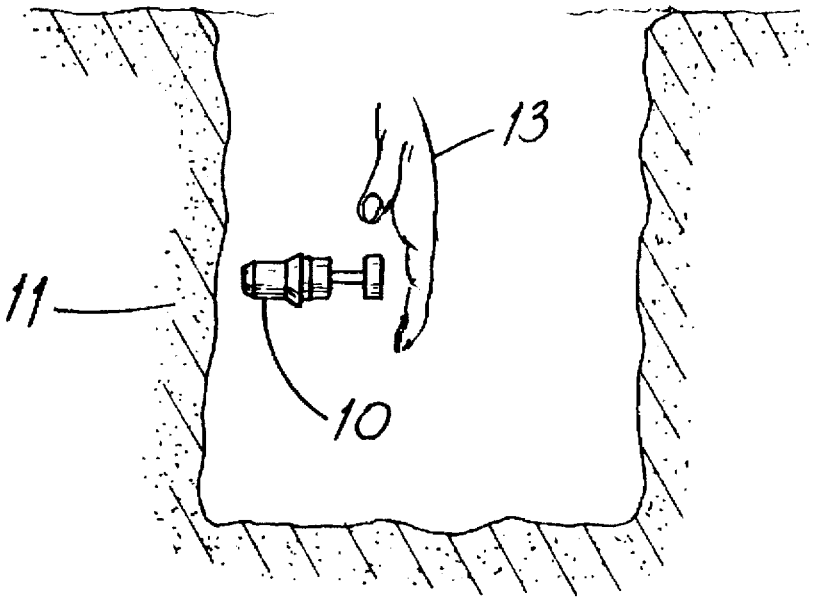
FIG. 1 is a sectional elevation view showing how the new tool is hand-urged into possibly-contaminated soil.
Figure 2:
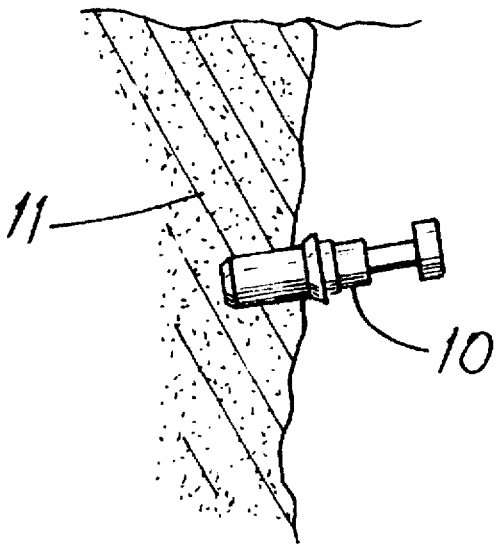
FIG. 2 is a sectional elevation view showing the tool in the soil.

Referring first to FIG. 1, the new soil sampling tool 10 is of the type which is urged into possibly-contaminated soil 11 by using one's hand 13. That is to say, the tool 10 is not hammered into the soil 11 nor is a pre-drilled hole formed in the soil 11 to accept the tool 10. The matter of soil sampling generally is discussed in U.S. Pat. No. 5,517,868 (Turriff et al.) which is incorporated herein by reference.

Referring next to FIGS. 3 through 11, the main components of the new tool 10 include a barrel 15, a plunger 17, a handle 19 and a cap 21 for closing the knife-like distal end 23 of the barrel 15 when a sample 25 is contained therein. Such components are discussed below in that order.

The barrel 15 includes a generally-cylindrical but slightly-tapered interior barrel wall 27 around a sampling cavity 29 in which a soil sample 25 is received. The barrel 15 has an annular, substantially flat surface which is spaced from the distal cutting end 23 and which forms an interior terminus 31. Extending along the barrel proximal end 33 is an axial passage 35 to accommodate the stem 37 of the plunger 17 with slight clearance. Such passage 35 is concentric with the long axis 39 of the barrel 15.

Referring particularly to FIGS. 3, 4, 5, 8 and 12, the new tool 10 includes a locking mechanism 14 which sets the volume of a contained soil sample 25 equal to a reference volume. Such mechanism 41 also provides a visual indication that such contained sample 25 has the requisite reference volume.

Particularly considering FIGS. 3, 4, 5 and 12, the face 43 of the proximal end 33 includes a first locking member 45 embodied as a cam-like ledge 45*a*. The ledge 45*a* is cam-like in that it gently slopes. When considered from point 47 to point 49, the ledge 45*a* slopes away from the distal end 23. Similarly, the ledge 45*b* gently slopes away from the distal end 23 when considered from point 51 to point 53. As will become more apparent from the description below, such sloping ledge 45*a* or 45*b* urges the plunger head 55 more snugly into the barrel cavity 29 when the plunger 17 is rotated. While only a single ledge 45*a*, 45*b* would suffice, a highly preferred locking member 45 incorporates both ledges 45*a*, 45*b* and such ledges 45*a*, 45*b* are spaced about 180° apart on the face 43.

Figure 3:
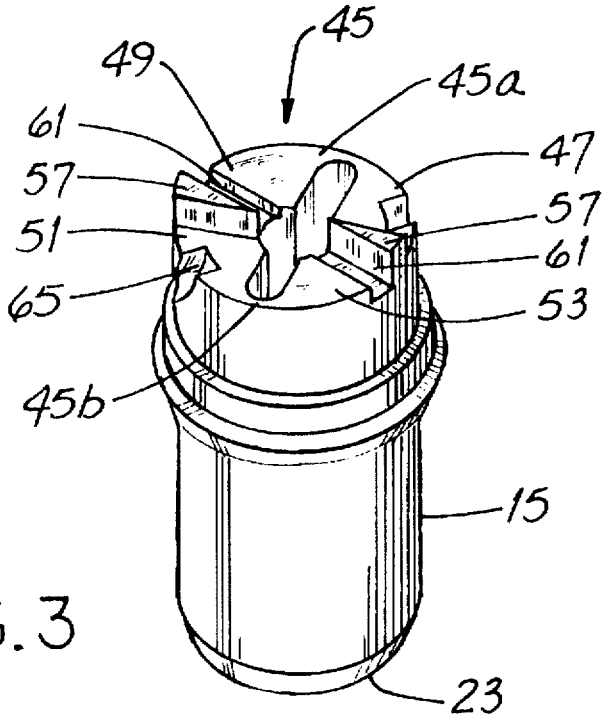
FIG. 3 is a perspective view of a component of the new tool, i.e., the barrel.
Figure 12:
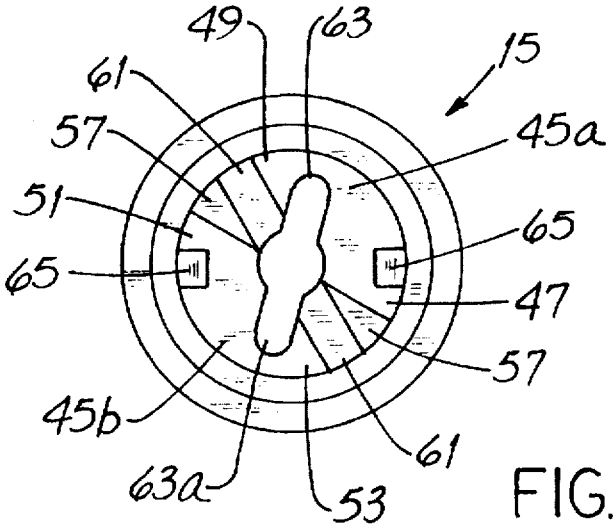
FIG. 12 is a top plan view of the tool barrel shown in FIGS. 3, 4 and 5. The view is taken along the viewing axis VA12 of FIG. 5.

At the ledge points 47, 51 nearest the barrel distal end 23, i.e., farthest from the viewer of FIG. 12, each ledge 45*a*, 45*b* is bounded by an upstanding stop 57 which is somewhat wedge-shaped in FIGS. 3 and 12. Each stop 57 extends away from the distal end 23, i.e., toward the viewer of FIG. 12. As further described below, the stops 57 prevent the plunger stem 37 and its arms 59 from being rotated in an improper direction. In the specific embodiment, the plunger stem 37 and its arms 59 may be rotated counterclockwise in the view of FIG. 12 and are prevented from rotating clockwise by the stops 57.

At the ledge points 49, 53 most distant from the barrel end 23, each ledge is bounded by a notch formed between the point 49, 53 and the stop 57 nearest such point 49, 53. As is also described below, the arms 59 of the plunger stem 37 engage respective notches 61 when the plunger 17 is rotated counterclockwise (as viewed in FIG. 12) to its "locked" position. Such notches 61 are not required to set the cavity volume-related dimension described below but the notches 61 are a distinct convenience when handling a sample 25 in the barrel 15.

It is desirable to retain the plunger 17 and the barrel 15 in a particular rotational relationship to one another as a soil sample 25 is being taken. To that end, the barrel proximal end 33 also includes at least one and preferably two deformations 63. Each such deformation 63 is otherwise referred to in this specification as a "first deformation." In a specific embodiment, each first deformation 63 is a groove 63*a* formed along the stem passage 35 and circumferentially spaced about 180° from the other groove 63*a*.

Referring now to FIGS. 5, 8, 9 and 12, for easy handle attachment, the barrel proximal end 33 includes a pair of channels 65, each of which extends from the proximal end 33 toward the distal end 23 and then angularly in a circumferential direction.

A convenient handle 19 is T-shaped and has a gripping portion 67 and a barrel attachment portion 69 perpendicular thereto. Near its distal end 71, the attachment portion 69 interior has a pair of pins 73 which are diametrically opposed and which extend from such portion 69 toward the portion long axis 75. The handle 19 and barrel 15 are attached to one another by sliding the pins 73 into the channels 65 and during final travel, twisting the barrel 15 and handle 19 relative to one another to couple them together.

Figure 6:
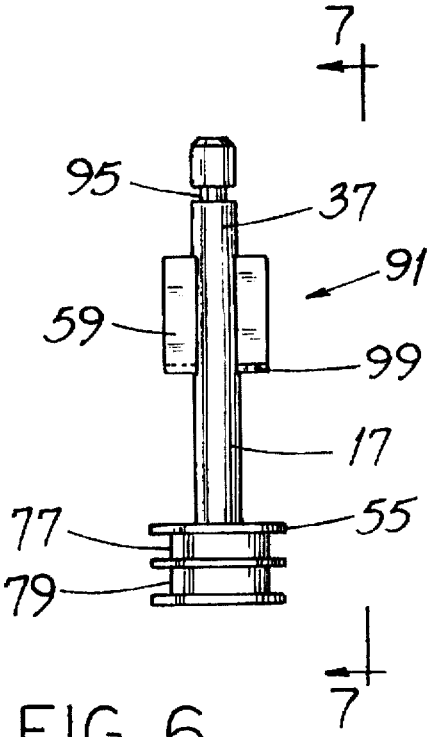
FIG. 6 is an elevation view of another component of the tool, i.e., the stem. The stem head O-rings are omitted.
Figure 7:
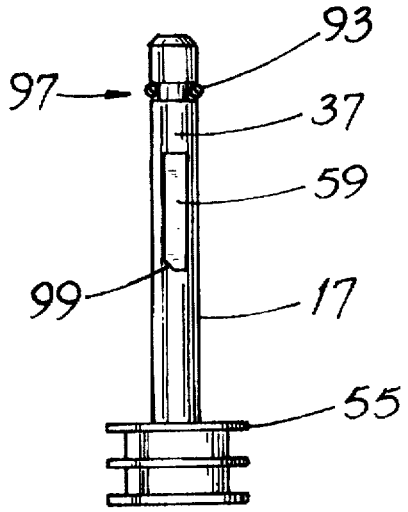
FIG. 7 is an elevation view of the stem of FIG. 6 taken along the viewing plane 7—7 thereof.
Figure 8:
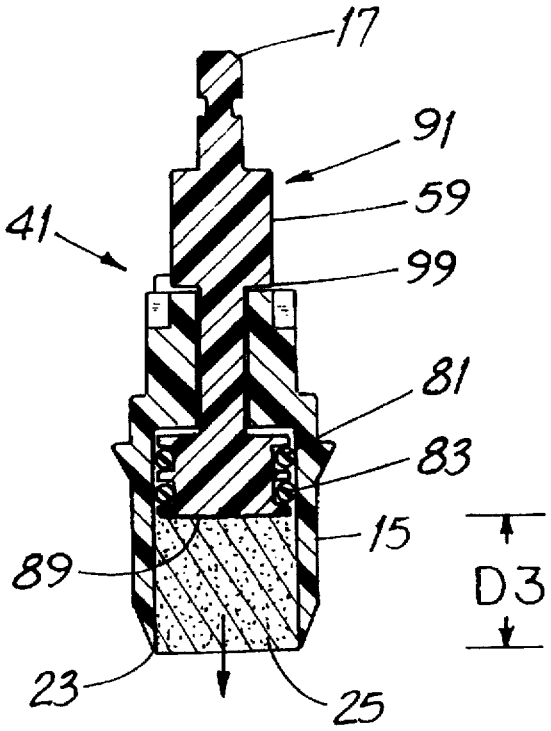
FIG. 8 is a cross-sectional elevation view of the barrel and stem assembled to one another. Such view is taken along a viewing plane coincident with the barrel long axis.
Figure 11:
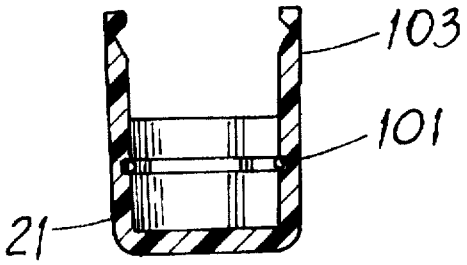
FIG. 11 is a cross-sectional elevation view of the cap of FIG. 10 taken along the viewing plane 11—11 thereof.
Figure 10:
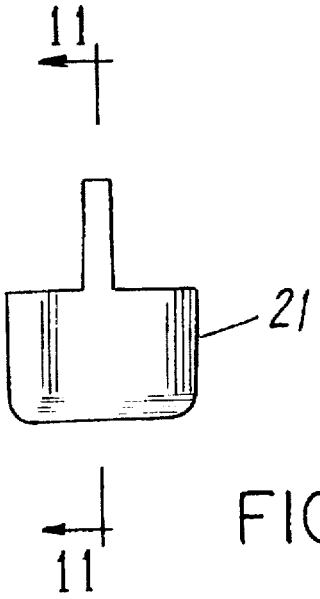
FIG. 10 is a side elevation view of still another component of the tool, i.e., the cap.
Figure 9:
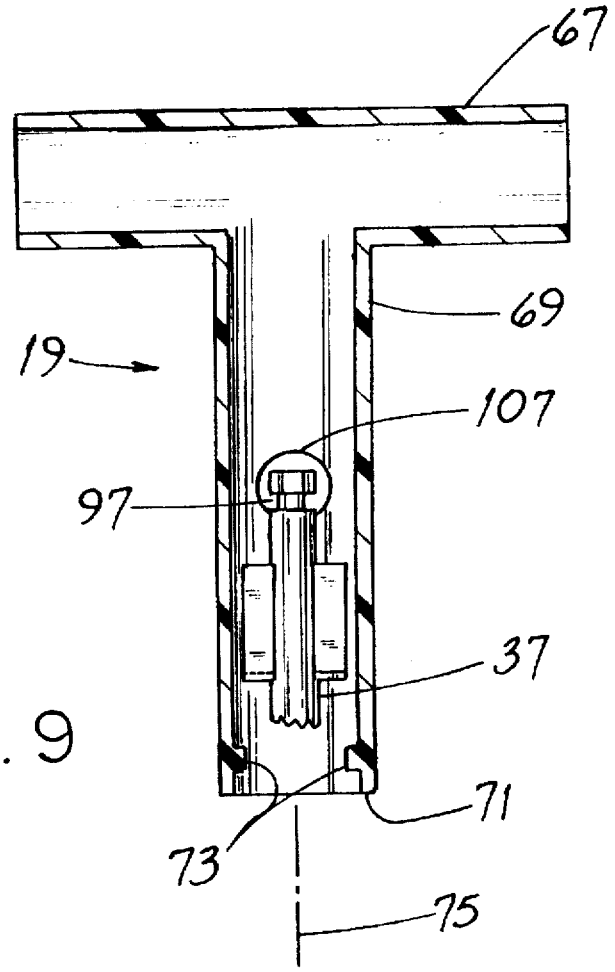
FIG. 9 is a cross-sectional elevation view of yet another component of the tool, i.e., the handle, shown in conjunction with a portion of the stem. Parts are broken away.

The tool plunger 17 will now be described. Referring next to FIGS. 6, 7 and 8, the plunger 17 includes a generally-cylindrical head 55 and a rod-like stem 37 extending axially from such head 55. When the plunger 17 is in the barrel 15, the head 55 and stem 37 are concentric with the barrel long axis 39.

Figure 13:
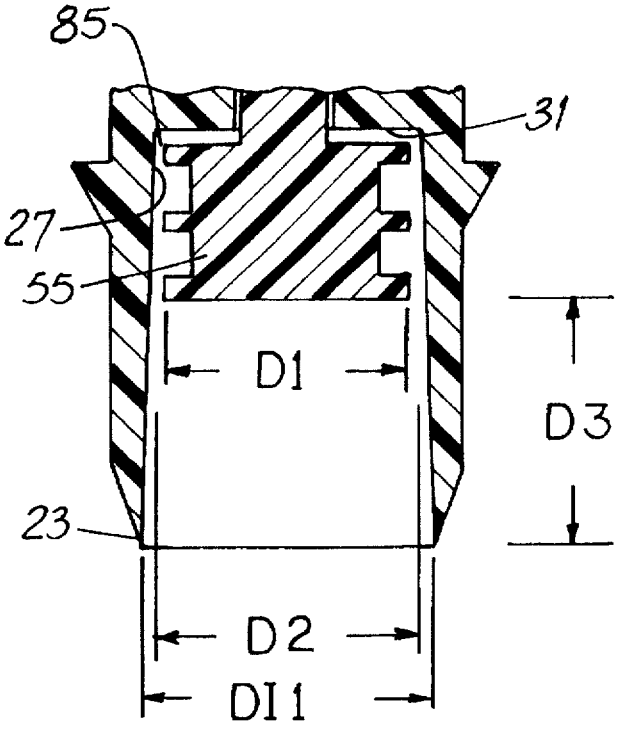
FIG. 13 is another cross-sectional elevation view of the barrel and stem assembled to one another. Parts are broken away.

The head 55 has a pair of axially-spaced-apart circumferential grooves 77 and 79, each of which has a respective O-ring seal 81, 83 retained therein. As shown in FIG. 13, the maximum diameter D1 of the head 55 per se (disregarding the O-rings 81,83) and the minimum diameter D2 of the barrel cavity 29 (such cavity 29 is slightly tapered) are cooperatively selected to define an annular space 85 between the head 55 and the barrel wall 27. (Viewed more broadly for cavities 29 and heads 55 which may be other than circular, the head 55 has a somewhat smaller cross-sectional area than that of the cavity 29 so that the head 55 and the wall 27 define a space between them.)

Figure 4:
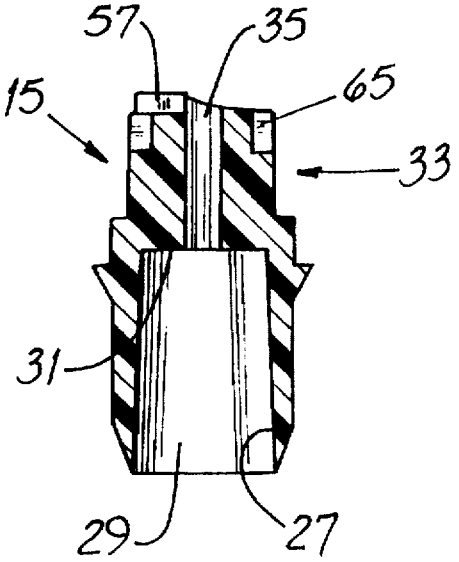
FIG. 4 is a cross-sectional elevation view of the barrel of FIG. 3. Such view is taken along a viewing plane coincident with the barrel long axis.
Figure 5:
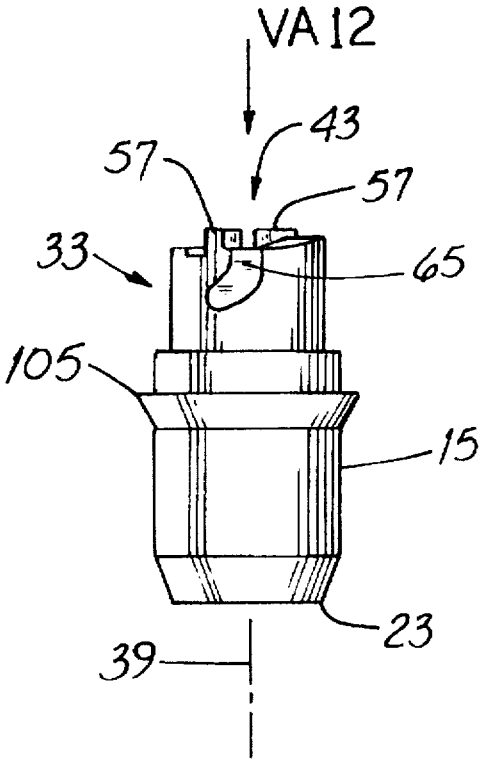
FIG. 5 is an elevation view of the barrel of FIGS. 3 and 4.

Considering FIGS. 4, 8 and 13, the space 85 between the head 55 and the barrel wall 27 is closed by the O-rings 81, 83 when the plunger head 55 is closely adjacent to the barrel terminus 31. And because the barrel cavity 29 is slightly tapered, there is very slight clearance 87 between the O-rings 81, 83 and the barrel wall 27 until just before the head 55 "seats" at or near the terminus 31—note FIG. 14.

As shown in FIG. 8, the plunger 17 includes a soil-contact surface 89 spaced from the distal end 23 by a dimension D3 when the barrel cavity 29 is filled with a soil sample 25 having a volume V. The role played by such surface 89 in obtaining a sample 25 of a particular volume and presumed weight will become apparent.

Referring next to FIGS. 6,7 and 8, the stem 37 has at least one laterally-extending deformation 91 and, preferably, has a pair of such deformations 91. (Each such deformation 91 is also referred to as a "second deformation.") In a specific embodiment, each deformation 91 is embodied as a paddle-like arm 59 and such arms 59 are spaced about 180° apart on the stem 37. The stem is fitted with a small O-ring 93 in a groove 95 to help prevent the plunger 17 from falling out of the barrel 15. Such O-ring 93 also serves as a volume marker 97 as described below.

Each arm 59 has a bevelled surface 99 along one lower edge. Such surfaces 99 make it easier for the arms 59 to engage and travel along their respective ledges 45*a*, 45*b* when the stem 37 is rotated as described below.

The first deformations 63 (grooves 63*a*) on the one hand and the second deformations 91 (e.g., arms 59) on the other are conformably shaped to one another so that the stem 37 may freely move axially in the barrel 15 but yet is prevented from substantial rotational movement so long as the deformations 63 and 91 engage one another. (Clearly, such deformations 63 and 91 need not be grooves 63*a* and arms 59, respectively. Other geometric shapes and shape positions are possible. As to the latter, a deformation embodied as an arm may project from the stem passage 35 into, say, a groove along the stem 37.)

Referring to FIG. 8, it is apparent that the distance D3 between the soil-contact surface 89 and the end 23 governs the volume V of a soil sample 25 that can be contained in the cavity 29. From FIG. 8, it is also apparent that when the surfaces 99 of the arms 59 are in axial registry with the ledges 45*a*, 45*b*, the soil-contact surface 89 is at some known dimension D3 from the end 23. Such dimension D3 is referred to as a reference dimension.

The locking mechanism 41 indicates in two ways that the dimension D3 is equal to a reference dimension and that the volume V of a barrel-contained soil sample 25 is established to be equal to some predetermined reference volume. One way is visually in that the surfaces 99 of the arms 59, are axially aligned with the ledges 45*a*, 45*b*. Another is tactiley; the stem 37 cannot be rotated to urge the arms 59 along their respective ledges 45*a*, 45*b* unless the soil-contact surface 89 is at some known dimension from the end 23. Recognizing that when preparing to take a soil sample 25, the recommended starting place for the plunger head 55 is at the barrel distal end 23 (as in FIG. 14), the tool user is assured that the volume V of the soil sample 25 that has pushed into the cavity 29 is that volume which yields a sample weight on the order of 5 grams.

As noted above, the locking mechanism 41 coacts between the proximal end 33 and the stem 37. Yet another benefit of such mechanism 41 is that when locked, it prevents movement of the stem 37 toward the distal end 23.

It is also to be noted that unlike the devices shown in the Puckett and Zapico patents mentioned above, the head of the new tool 10 is free of any mechanism for adjusting the compression of the sealing ring 81 or 83. Assuming that the head 55 and cavity 29 are properly dimensioned and that properly sized O-rings 81, 83 are on the head 55, the absence of a compression-adjusting mechanism is an advantage. The user can be sure that at least one O-ring 81 fits against the barrel wall 27 with sufficient snugness to retain VOC vapors (e.g., the vapor of evaporating gasoline in the soil sample 25) while yet permitting the force of tool insertion to cause the soil sample 25 to urge the head 55 substantially to the terminus 31.

Figure 15:
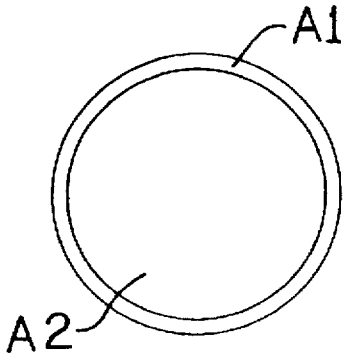
FIG. 15 is a representation of area relationships. Such representation is taken along viewing axis VA15 of FIG. 13.

Referring next to FIGS. 13 and 15, in yet another aspect of the invention, the barrel distal end 23 defines a first area A1 and, in a more specific embodiment, has a first diameter D1. The cavity terminus 31 defines a second area A2 smaller than the first area A1 and, more specifically, has a second diameter D2 less than the first diameter D1. So configured, the cavity 29 is slightly tapered and has a progressively-smaller cross-sectional area when viewed from the distal end 23 to the terminus 31.

Figure 14:
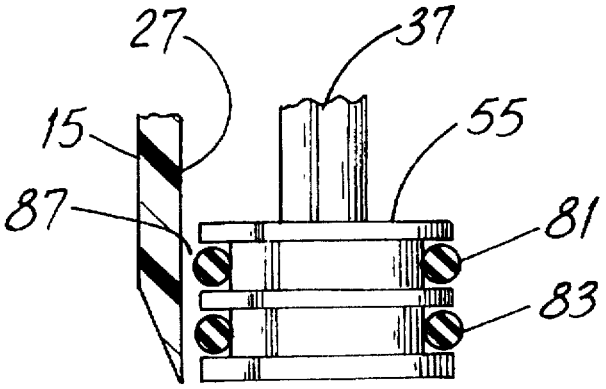
FIG. 14 is an elevation view showing a portion of the barrel in cross-section and the stem head in full representation. Parts are broken away.

In the highly preferred embodiment having two sealing rings 81, 83 shown in FIGS. 8 and 14, one of the rings, ring 83, is redundant for containing vapor of a VOC in the barrel 15. And that ring 83 closest to the barrel distal end 23 acts as a secondary seal which helps prevent dirt from working its way under the other ring 81 and impairing the integrity of VOC vapor retention.

In use, the plunger 17 is positioned in the barrel 15 so that the soil-contact surface 89 is about in registry with the end 23. The handle 19 is thereupon attached and the barrel distal end 23 urged into the soil 11 from which a sample 25 is desired to be taken. When the user believes the cavity 29 is filled to the prescribed volume, the tool 10 is withdrawn.

Thereupon, the user may remove the handle 19 and visually inspect the tool 10 to see whether the surfaces 99 of the arms 59 are axially aligned with the ledges **45*a*, 45*b*. If they are, the cavity 29 contains the requisite volume. (If the cavity 29 does not contain the requisite volume, the tool 10 is urged more forcefully into the soil 11**.)

In the alternative (or in addition), the user attempts to rotate the stem 37 and barrel 15 with respect to one another. If rotation can be accomplished without further drawing the stem head 55 up into the barrel 15, the cavity 29 contains the requisite volume. In the latter instance, the stem 37 is rotated until the arms 59 engage their respective locking notches 61, thereby securing the stem 37. Noting FIGS. 5, 8, 10 and 11, the cap 21 with its sealing O-ring 101 is urged over the distal end 23 until the cap retention arms 103 engage the barrel surface distortion, e.g., a circumferential ridge 105 around the barrel 15. The possibly-VOC-contaminated soil sample 25 is thereby sealed in the barrel 15 and can be taken to a laboratory for analysis.

Referring again to FIGS. 7 and 9, the handle 19 of the tool 10 optionally includes a sighting aperture 107 in the handle attachment portion 69. The plunger stem 37 optionally includes a volume marker 97 thereon and in a specific embodiment, the O-ring 93 serves as such marker 97. That is, the O-ring groove 95 and the aperture 107 are cooperatively, axially positioned so that the aperture 107 and the marker 97 are aligned with one another when the plunger head 55 is against or closely adjacent to the barrel terminus 31. That positional relationship occurs when the barrel 15 is filled with a soil sample 25 having a volume V substantially equal to a reference volume, e.g., a volume characteristic of a soil sample 25 weighing about 5 grams. (It is apparent from the foregoing that when the aperture 107 and marker 97 are used, one need not remove the handle 19 from the barrel 15.)

Figure 16:
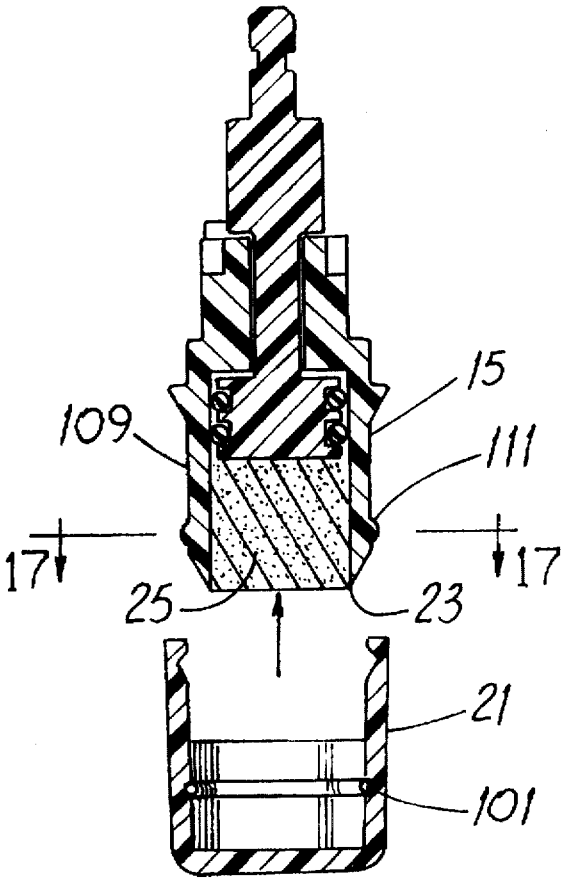
FIG. 16 is a cross-sectional elevation view of the barrel and stem assembled to one another, the barrel containing a soil sample and the closure cap positioned for sealing placement on the barrel.
Figure 17:
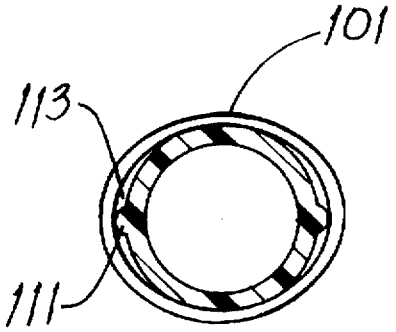
FIG. 17 is a simplified view taken along viewing plane 17—17 of FIG. 16 and showing how a barrel rib compresses the cap O-ring, thereby creating an air vent.

Referring now to FIGS. 16 and 17, another desirable feature of the tool 10 helps assure that when capping the tool barrel 15, no air will be trapped between the barrel distal end 23 (and between the soil sample 25 in the barrel 15) and the cap 21 fitted on such distal end 23. To help prevent air entrapment, the barrel outer surface 109 has at least one axially-oriented rib 111 thereon and preferably has plural ribs 111. As the cap 21 is mounted on the barrel distal end 23, the rib 111 compresses the sealing ring 101 and forms a small opening 113 between such ring 101 and such surface 109. Air between the cap 21 and the soil sample 25 is vented through such opening 113 as the cap 31 is being mounted.

While the principles of the invention have been shown and described in connection with only a few preferred embodiments, it is to be understood clearly that such embodiments are byway of example and are not limiting.

What is claimed:

1. In a soil-sampling tool including a barrel having a barrel outer surface, a distal end for insertion into soil, a proximal end spaced from the distal end, a stem passage extending between the proximal and distal ends and a plunger having an elongate stem movable in the stem passage, such plunger including a soil-contact surface spaced from the distal end by a dimension when the barrel is filled with a soil sample having a volume, the improvement wherein:

the tool includes a locking mechanism setting the dimension equal to a reference dimension, thereby establishing the volume of the soil sample;

and wherein the locking mechanism includes:

a groove formed in the barrel, such groove being, open to the stem passage and spaced from the barrel outer surface;

an arm attached to the stem and being in registry with the groove when the stem moves in the stem passage;

a ledge on the proximal end of the barrel;

and wherein:

the arm and the ledge engage one another by rotating the stem with respect to the barrel.

2. The tool of claim 1 wherein:

the ledge is a cam surface which slopes with respect to the barrel distal end.

3. The tool of claim 1 wherein:

the groove and the arm are conformably-shaped to guide movement of the stem in the proximal end.

4. The tool of claim 1 wherein the barrel includes a sampling cavity defined by the barrel distal end for receiving the soil sample therethrough, a cavity terminus and a substantially cylindrical barrel wall extending between the distal end and the terminus, and wherein the plunger is mounted for movement in the cavity and includes a head, and wherein:

the head and the wall define a space therebetween;

the head includes a resilient sealing ring thereon for sealing against the wall adjacent to the terminus and closing the space; and the head is free of any mechanism for adjusting compression of such sealing ring.

5. The tool of claim 4 wherein:

the distal end defines a first area;

the terminus defines a second area smaller than the first area; and the cavity is slightly tapered from the distal end to the terminus.

6. The tool of claim 4 wherein:

the head includes plural resilient sealing rings thereon for sealing against the wall and closing the space; and the head is free of any mechanism for adjusting the compression of the sealing rings.

7. The tool of claim 1 wherein:

the barrel has a handle attached thereto, such handle having a sighting aperture;

the plunger stem has a volume marker thereon; and the aperture and the marker are aligned with one another when the barrel is filled with a soil sample having a volume substantially equal to a reference volume.

8. The tool of claim 1 further including a cap for mounting on the barrel distal end, such cap having a sealing ring, and wherein:

the barrel outer surface has at least one rib thereon; and the rib compresses the sealing ring as the cap is mounted on the barrel distal end, thereby venting air between the cap and the soil sample.

9. In a sampling tool for hand insertion into soil and including a barrel having (a) a proximal end with a hand-grip handle coupled thereto, (b) a barrel wall around a sampling cavity, and (c) a plunger mounted for movement in the cavity, such plunger including a head and a stem extending from the head into the proximal end, the improvement wherein:

the head and the wall define a space therebetween;

the head includes a resilient sealing ring thereon for sealing against the wall and closing the space;

the barrel includes a distal cutting end having a first diameter;

the barrel includes a cavity terminus spaced from the distal end and having a second diameter less than the first diameter, thereby providing a cavity which is slightly tapered.

10. The tool of claim 9 wherein:

the cavity has a soil sample therein and such sample has a volume;

the proximal end includes a sloped camming ledge;

the stem includes an arm in sliding engagement with the ledge; and the volume of the sample is equal to a reference volume when the arm and the ledge are aligned.

11. The tool of claim 9 wherein:

the head is free of any mechanism for adjusting compression of the sealing ring.

12. The tool of claim 9 wherein:

the handle has a sighting aperture;

the stem has a volume marker thereon; and the aperture and the marker are aligned with one another when the barrel is filled with a soil sample having a volume substantially equal to a reference volume.

13. The tool of claim 9 further including a cap for mounting on the barrel distal end, such cap having a sealing ring separate from the sealing ring on the head, and wherein:

the barrel has an outer surface with at least one rib thereon; and the rib compresses the said separate sealing ring as the cap is mounted on the barrel distal end, thereby venting air between the cap and a soil sample received in the barrel.

14. In a soil-sampling tool including a barrel having (a) a distal end for insertion into soil, and (b) a plunger mounted for movement in the barrel, such plunger including a soil-contact surface spaced from the distal end by a dimension when the barrel is filled with a soil sample having a volume, the improvement wherein:

the tool includes a locking mechanism setting the dimension equal to a reference dimension, thereby establishing the volume of the soil sample;

the barrel has a handle attached thereto and the handle has a sighting aperture;

the plunger has a stem extending therefrom and the stem has a volume marker thereon; and the aperture and the marker are aligned with one another when the barrel is filled with a soil sample having a volume substantially equal to a reference volume.

15. In a soil-sampling tool including a barrel having (a) a distal end for insertion into soil, and (b) a plunger mounted for movement in the barrel and including a soil-contact surface spaced from the distal end by a dimension when the barrel is filled with a soil sample having a volume, the improvement wherein:

the tool includes a locking mechanism setting the dimension equal to a reference dimension, thereby establishing the volume of the soil sample;

the tool includes a cap for mounting on the barrel distal end, such cap having a sealing ring, and wherein:

the barrel has an outer surface with at least one rib thereon; and the rib compresses the sealing ring as the cap is mounted on the barrel distal end, thereby venting air between the cap and the soil sample.

16. In a soil-sampling tool including a barrel having (a) a distal end for insertion into soil, and (b) a plunger mounted for movement in the barrel, such plunger including a soil-contact surface spaced from the distal end by a dimension when the barrel is filled with a soil sample having a volume, the improvement wherein:

the barrel includes a proximal end spaced from the distal end;

the plunger includes a stem extending through the proximal end;

the tool includes a locking mechanism setting the dimension equal to a reference dimension for establishing the volume of the soil sample, such locking mechanism including a first locking member at the proximal end and a second locking member fixed with respect to the stem and engaging the first locking member when the dimension is equal to the reference dimension;

the engaged locking members prevent movement of the stem toward the distal end;

the barrel includes a sampling cavity defined by the barrel distal end for receiving the soil sample therethrough, a cavity terminus and a barrel wall extending between the distal end and the terminus;

the plunger is mounted for movement in the cavity and includes a head:

the head and the wall define a space therebetween;

the head includes plural resilient sealing rings thereon for sealing against the wall adjacent to the terminus and closing the space;

the head is free of any mechanism for adjusting the compression of the sealing rings.

17. In a sampling tool for hand insertion into soil and including a barrel having (a) a proximal end with a hand-grip handle coupled thereto, (b) a barrel wall around a sampling cavity, and (c) a plunger mounted for movement in the cavity, such plunger including a head and a stem extending from the head into the proximal end, the improvement wherein:

the head and the wall define a space therebetween;

the head includes a resilient sealing ring thereon for sealing against the wall and closing the space;

the barrel includes a distal end having a first diameter;

the barrel includes a cavity terminus spaced from the distal end and having a second diameter less than the first diameter, thereby providing a cavity which is slightly tapered;

the handle has a sighting aperture;

the stem has a volume marker thereon; and the aperture and the marker are aligned with one another when the barrel is filled with a soil sample having a volume substantially equal to a reference volume.

18. In a sampling tool for hand insertion into soil and including a barrel having (a) a proximal end with a hand-grip handle coupled thereto, (b) a barrel wall around a sampling cavity, and (c) a plunger mounted for movement in the cavity, such plunger including a head and a stem extending from the head into the proximal end, the improvement wherein:

the head and the wall define a space therebetween;

the head includes a resilient sealing ring thereon for sealing against the wall and closing the space;

the barrel includes a distal end having a first diameter;

the barrel includes a cavity terminus spaced from the distal end and having a second diameter less than the first diameter, thereby providing a cavity which is slightly tapered;

and wherein:

tool includes a cap for mounting on the barrel distal end, such cap having a sealing ring:

the barrel has an outer surface with at least one rib thereon; and the rib compresses the sealing ring as the cap is mounted on the barrel distal end, thereby venting air between the cap and a soil sample.

* * * * *

UNITED STATES PATENT AND TRADEMARK OFFICE

CERTIFICATE OF CORRECTION

PATENT NO. : 5,706,904

DATED : January 13, 1998

INVENTOR(S) : David E. Turriff, Lloyd E. Jacobs, Nils K. Melberg, Christopher A. Reitmeyer

It is certified that error appears in the above-identified patent and that said Letters Patent is hereby corrected as shown below:

In column 10, line 30, delete "byway" and insert --by way--.

In claim 18, line 17, insert --the-- before "tool".

Signed and Sealed this

Fourteenth Day of April, 1998

Bruce Lehman

*Attest:*

BRUCE LEHMAN

*Attesting Officer*

*Commissioner of Patents and Trademarks*